US006551183B2

(12) United States Patent
Knox, Jr. et al.

(10) Patent No.: US 6,551,183 B2
(45) Date of Patent: Apr. 22, 2003

(54) SNACK DISPENSER AND COIN BANK

(75) Inventors: William J. Knox, Jr., Painesville, OH (US); Paul Tamulewicz, Cleveland, OH (US)

(73) Assignee: Mag-Nif Incorporated, Cleveland, OH (US)

( * ) Notice: Subject to any disclaimer, the term of this patent is extended or adjusted under 35 U.S.C. 154(b) by 0 days.

(21) Appl. No.: 09/780,906

(22) Filed: Feb. 9, 2001

(65) Prior Publication Data

US 2002/0108835 A1 Aug. 15, 2002

(51) Int. Cl.[7] ..... G07D 1/00; A63H 29/08
(52) U.S. Cl. ..... 453/18; 446/168
(58) Field of Search ..... 453/18, 19, 63; 446/6, 10, 168, 173

(56) References Cited

U.S. PATENT DOCUMENTS

| | | | | |
|---|---|---|---|---|
| 1,572,090 A | * | 2/1926 | Smith | |
| 4,762,512 A | | 8/1988 | Divnick | 446/8 |
| 4,871,055 A | | 10/1989 | Poythress et al. | 194/344 |
| 5,082,101 A | * | 1/1992 | Baker et al. | 194/350 |
| 5,176,238 A | | 1/1993 | Deglau | 194/338 |
| 5,244,071 A | * | 9/1993 | Lobl | 194/342 |
| 5,664,698 A | | 9/1997 | Nottingham et al. | 222/2 |
| 5,782,378 A | * | 7/1998 | Hart et al. | 221/155 |
| 5,888,115 A | | 3/1999 | Shoemaker, Jr. et al. | 446/168 |
| 5,911,299 A | * | 6/1999 | Aspnes et al. | 194/344 |
| 6,378,724 B1 | * | 4/2002 | Chang | 221/155 |
| 2002/0036209 A1 | * | 3/2002 | Chang | 221/121 |

OTHER PUBLICATIONS

"Mag–Nif Makes it in the U.S.A.!" Brochure, 1999.

* cited by examiner

*Primary Examiner*—Donald P. Walsh
*Assistant Examiner*—Mark J. Beauchaine
(74) *Attorney, Agent, or Firm*—Fay, Sharpe, Fagan, Minnich & McKee, LLP

(57) ABSTRACT

A snack dispenser and coin bank is disclosed. The assembly includes a housing and a shaft member making up a portion of the housing. A first storage area is located in the housing for storing associated snacks and a dispenser is movably mounted in the shaft for selectively dispensing the associated snack. A depositing member is movably mounted in the housing for selectively allowing the deposit of associated coins in the housing, the depositing member being operatively connected to the dispenser. An actuator is mounted on the dispenser, and when the actuator is moved to one position, it actuates the dispenser and the depositing member. A method of saving coins and receiving a snack is also provided.

22 Claims, 13 Drawing Sheets

FIG. 4
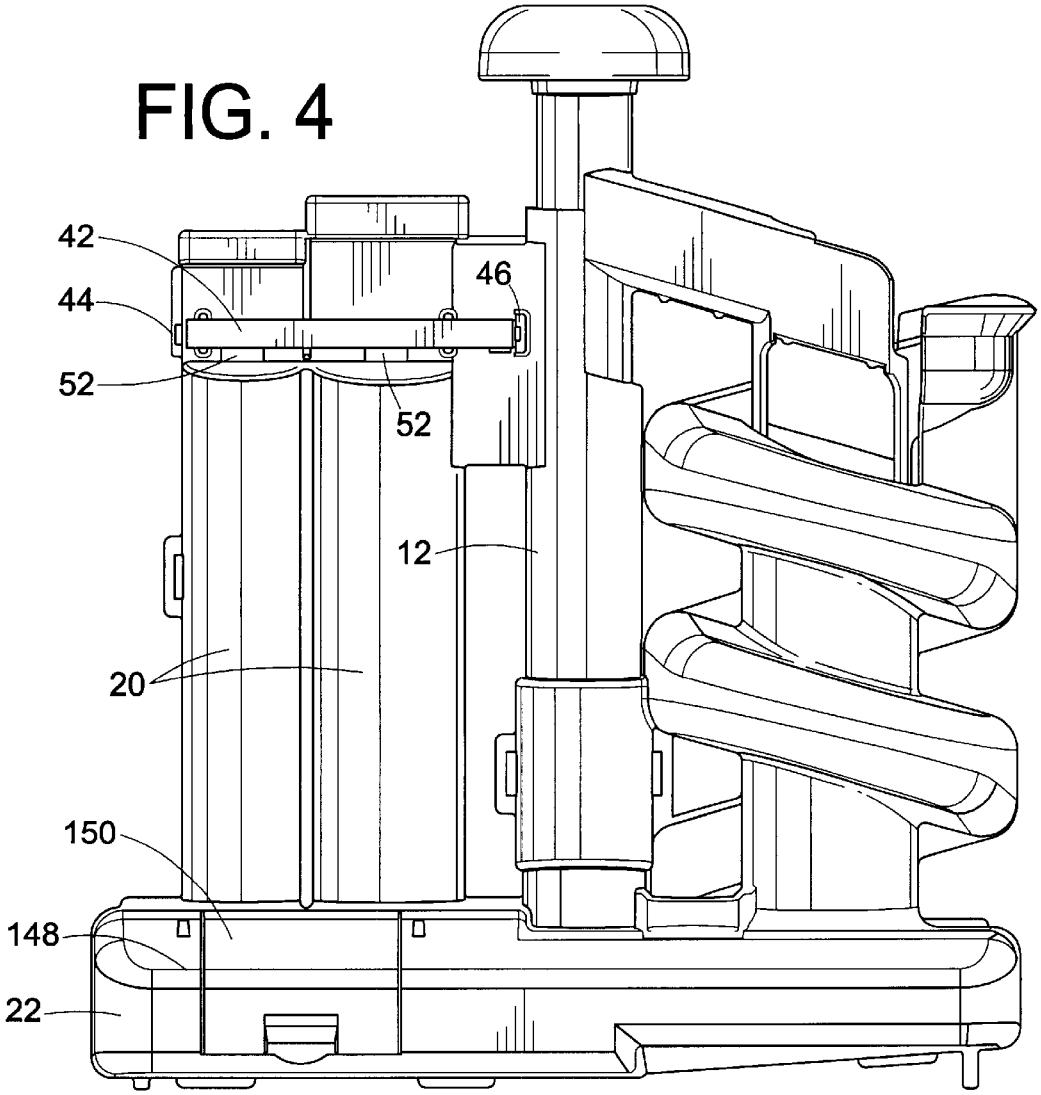
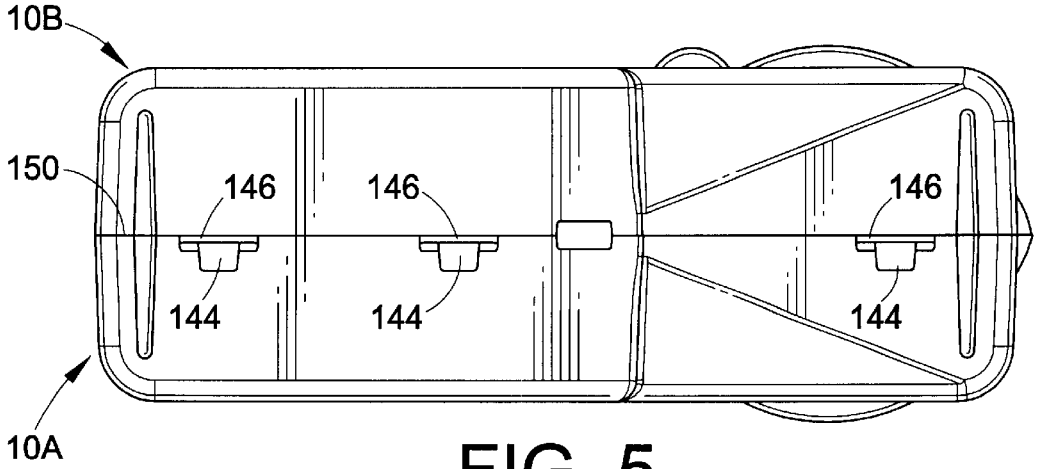
FIG. 5

24
126
96
124
104
68
70
100
106
58
102
62
56
60
114
98
64
92
94

SNACK DISPENSER AND COIN BANK

BACKGROUND OF THE INVENTION

1. Field of the Invention

The present invention relates to coin banks. More particularly, the present invention relates to a new coin bank providing entertainment and a snack as a reward for depositing coins.

2. Description of Related Art

Coin banks designed with children in mind have taken several forms. Some have consisted of a unique shape or appearance, such as the classic piggy bank. Others have been designed to dispense a reward such as candy or some similar treat when a coin is deposited. Still others have enabled a coin to travel into a holding area of the bank in a visually pleasing manner, entertaining a person who deposits money.

For example, U.S. Pat. No. 5,888,115 issued to Shoemaker, Jr. et al., U.S. Pat. No. 4,871,055 issued to Poythress et al. and U.S. Pat. No. 4,762,512 issued to Divnick all disclose funnel type devices in which a coin travels along the wall of the funnel when deposited. U.S. Pat. No. 5,176,238 issued to Deglau teaches the use of a coin collecting device in which a coin is observed traveling down a branching path before arriving at a collection area.

These inventions have been limited to a solely visual method of enticement for depositing a coin. Other prior art banks and dispensers, in attempting to solve this problem by offering several different modes of enticement, have consisted of very complex structures, often requiring motorized components. For example, U.S. Pat. No. 5,664,698 issued to Nottingham et al. teaches the use of a confectionery dispenser in which pieces of candy are dispensed when a coin is deposited. However, the invention is complex and requires motorized components, while lacking visual appeal to a child, the likely user of such a device. Accordingly, it is desirable to develop a new snack dispenser and coin bank which can both deliver a snack and deposit a coin in a visually entertaining manner, yet remain simple in construction and ease of operation.

SUMMARY OF THE INVENTION

According to the present invention, a new and improved snack dispenser and coin bank is provided.

In accordance with a first aspect of the present invention, a snack dispenser and coin bank is provided. The assembly includes a housing and a shaft member making up a portion of the housing. A first storage area is located in the housing for storing associated snacks and a dispenser is movably mounted in the shaft for selectively dispensing the associated snack. A depositing member is movably mounted in the housing for selectively allowing the deposit of associated coins in the housing, the depositing member being operatively connected to the dispenser. An actuator is mounted on the dispenser. When the actuator is moved to one position, it actuates the dispenser and the depositing member.

In accordance with another aspect of the present invention a snack dispenser and coin bank is provided. The assembly comprises a housing and a first storage area located in the housing for storing associated snacks. A dispenser is mounted in the housing for selectively dispensing the associated snacks and a second storage area is located in the housing for storing associated coins. A depositing member is mounted in the housing for selectively allowing the deposit of the associated coins into the second storage area. The depositing member is operatively connected to the dispensing member. At least one coin chute extends between the depositing member and the second storage area, the chute(s) defining a first end and a second end and an inner diameter greater than that of a coin denomination for which the coin chute is designed. The chute also defines a helical ramp along which the associated coins travel. An actuator is mounted on the dispenser, for selectively actuating the dispenser and the depositing member.

In accordance with yet another aspect of the present invention, a method of saving coins and receiving a snack is provided. The method includes placing at least one coin in an aperture defined at one end of a coin chute in a housing holding snacks and pressing an actuator knob mounted on the housing, releasing the coin and a snack into, respectively, a coin chute and a snack dispensing ramp, causing the coin and the snack to each travel in a generally downward direction, depositing the coin in a coin storage area in the housing and receiving the snack.

BRIEF DESCRIPTION OF THE DRAWINGS

The invention may take form in certain components and structures a preferred embodiment of which will be illustrated in the accompanying drawings wherein:

FIG. 4 is a rear elevational view of the dispenser and coin bank of FIG. 1;

FIG. 5 is a bottom plan view of the dispenser and coin bank of FIG. 1;

DETAILED DESCRIPTION OF THE PREFERRED EMBODIMENT

Figure 1:
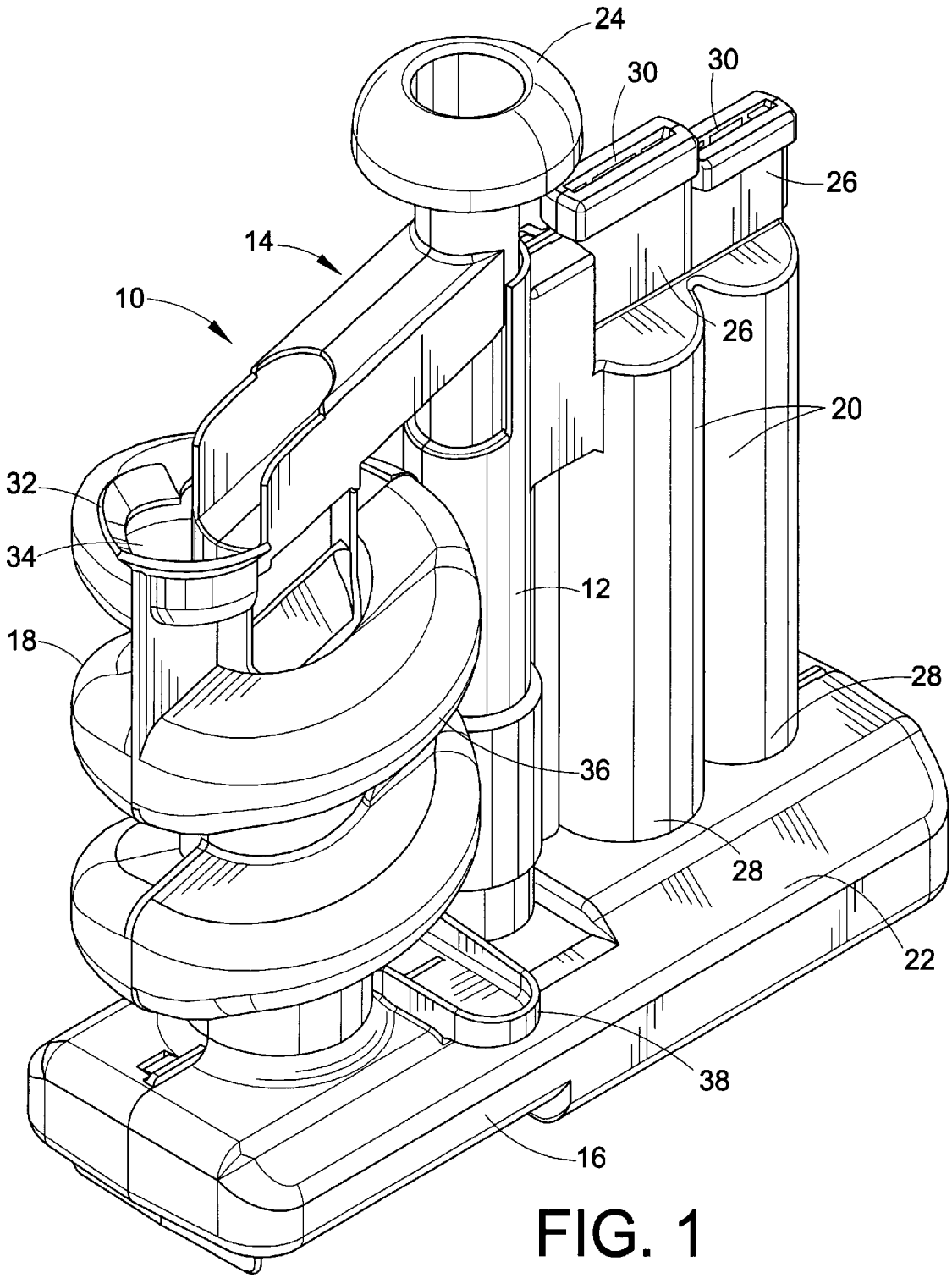
FIG. 1 is a perspective view of a dispenser and coin bank in accordance with one embodiment of the present invention.

Referring now to the drawings, wherein the showings are for purposes of illustrating a preferred embodiment of the invention only and not for purposes of limiting the same, FIG. 1 shows one embodiment of a snack dispenser and coin bank according to the current invention. A housing 10 comprises a shaft 12 which receives a dispenser 14. The dispenser 14 can vertically reciprocate in the shaft 12. The dispenser 14 communicates with a first, snack, storage area 16 that stores associated snacks. A ramp 18 through which a snack is dispensed as a reward for depositing money is mounted on one side of the housing 10. At least one chute 20, and preferably two, are mounted on another side of the housing 10. These chutes 20 allow a coin to travel from an inlet to a second, coin, storage area 22, as will be described herein. An actuator 24, which may take the form of a knob, is mounted at an upper end of the dispenser 14.

Each chute 20 includes a first end 26, a second end 28 and a slot 30. Upon actuation, coins pass from the slot 30 into the second storage area 22. Also upon actuation, an associated snack travels from the dispenser 14 to a first end of the ramp 18 and through an aperture 34 defined therein. The snack proceeds in a pleasing manner through the ramp 18 to a second end 36 of the ramp 18 and into a tray 38, where the snack is presented to the user.

Figure 11:
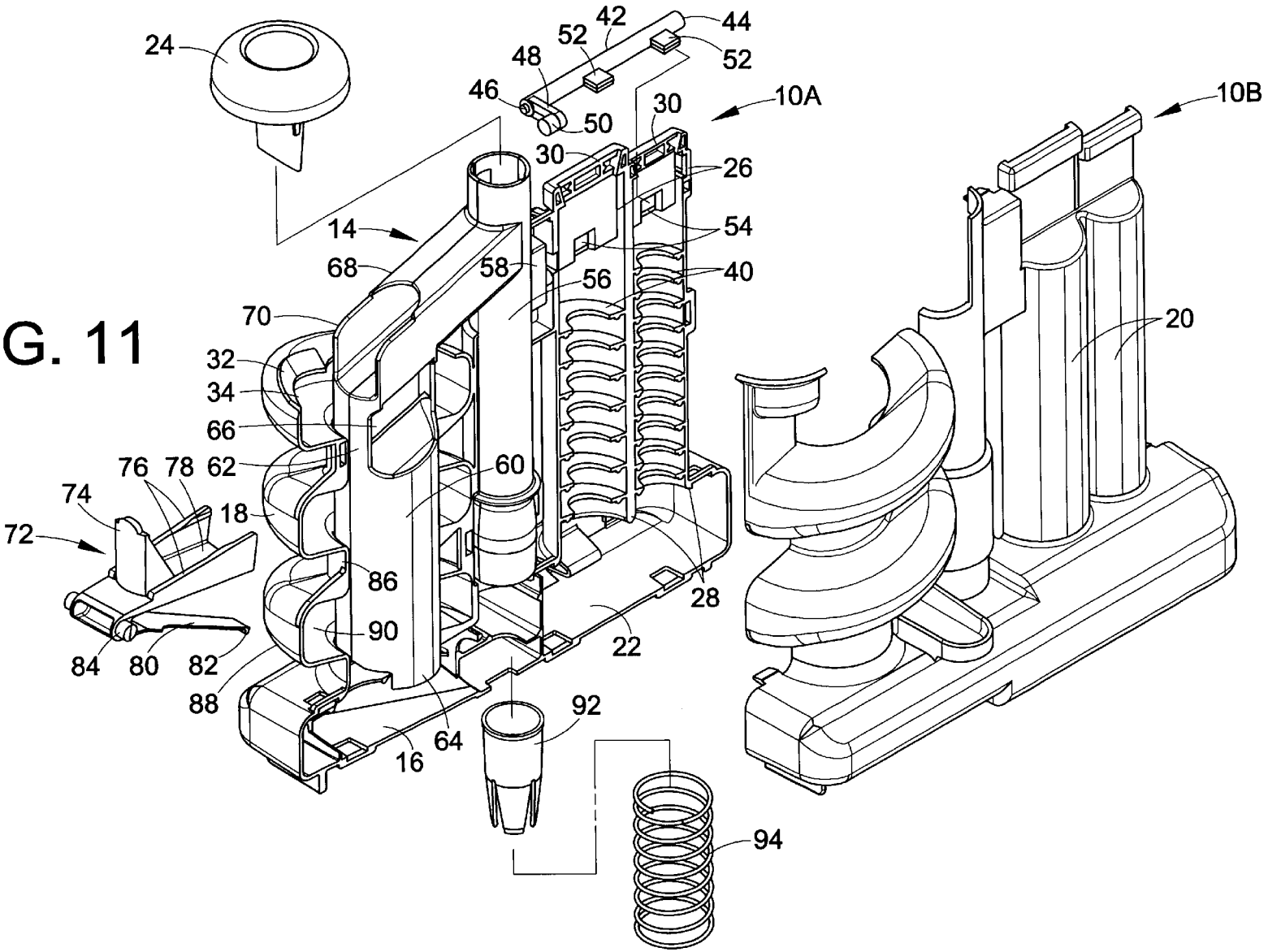
FIG. 11 is an exploded perspective view of the dispenser and coin bank of FIG. 1.

Turning now to FIG. 11, an exploded perspective view of the dispenser and coin bank illustrates many of the details of the present invention. Several of the components of the housing 10 may be formed as an integral unit. That unit may consist of two halves, 10A,10B, which are joined to form the complete housing 10 as will be described below. The slot 30 defined at the first end 26 of each coin chute 20 is appropriately sized with a width and length that is slightly larger than a coin of a particular denomination for which the chute 20 is designed. The inner diameter of each chute 20 is also larger than the diameter of the denomination of coin for which the chute 20 is designed. For example, the slot 30 and the inner diameter of one chute may be of a size to accept pennies and dimes. The slot 30 and the inner diameter of another chute 20 may be of a larger size to accept nickels and quarters. Extending into the inner diameter of each chute 20 are projections 40 which define a helically shaped ramp ledge when the housing halves 10A,10B are assembled. When a coin is deposited into the slot 30 and is released into the chute 20 upon actuation, the coin then rides the projections 40 in a downward spiraling manner, due to gravity. When the coin reaches the second end 28 of the chute 20, it exits the chute 20 and is deposited in the second storage area 22. The travel of a coin on the projections 40 creates a visually pleasing effect for a user. In addition, if two coins are inserted, one into each slot 20, the coins may appear to race in this pleasing manner. The projections 40 may be designed according to varying dimensions which may affect the speed or path of a deposited coin proceeding through the chute 20. Further, the projections 40 may take different patterns so as to form steps or configurations other than a helix.

With continuing reference to FIG. 11, a depositing member 42, which may take the form of a lever, controls the release of the coins from the slots 30 and into the chutes 20. The depositing member 42 is rotatably mounted to the housing 10 at a first end 44 and a second end 46. The depositing member is activated by the dispenser 14 through a flange 48 which extends from the second end 46 of the depositing member 42. A projection 50 mounted on the flange 48 contacts a portion of the dispenser 14 as will be described below. When the dispenser 14 is actuated, it moves in a downward direction. The projection 50 is contacted and also moves in a downward direction. Through the flange 48, the projection causes the depositing member 42 to rotate about its axis. Paddles 52 are mounted on the depositing member 42 and extend into apertures 54 defined in the first end 26 of each chute 20 below each slot 30. In a typical at-rest position, the paddles 54 extend across the slots 30 so as to block coin travel therethrough. When the dispenser 14 is actuated and the depositing member 42 is caused to rotate about its axis, the paddles 52 rotate in a downward manner in the apertures 54 until they are in a position generally flush with the wall of the first end 26 of each chute 20. This allows a coin to be released in a controlled manner.

Figure 9A:
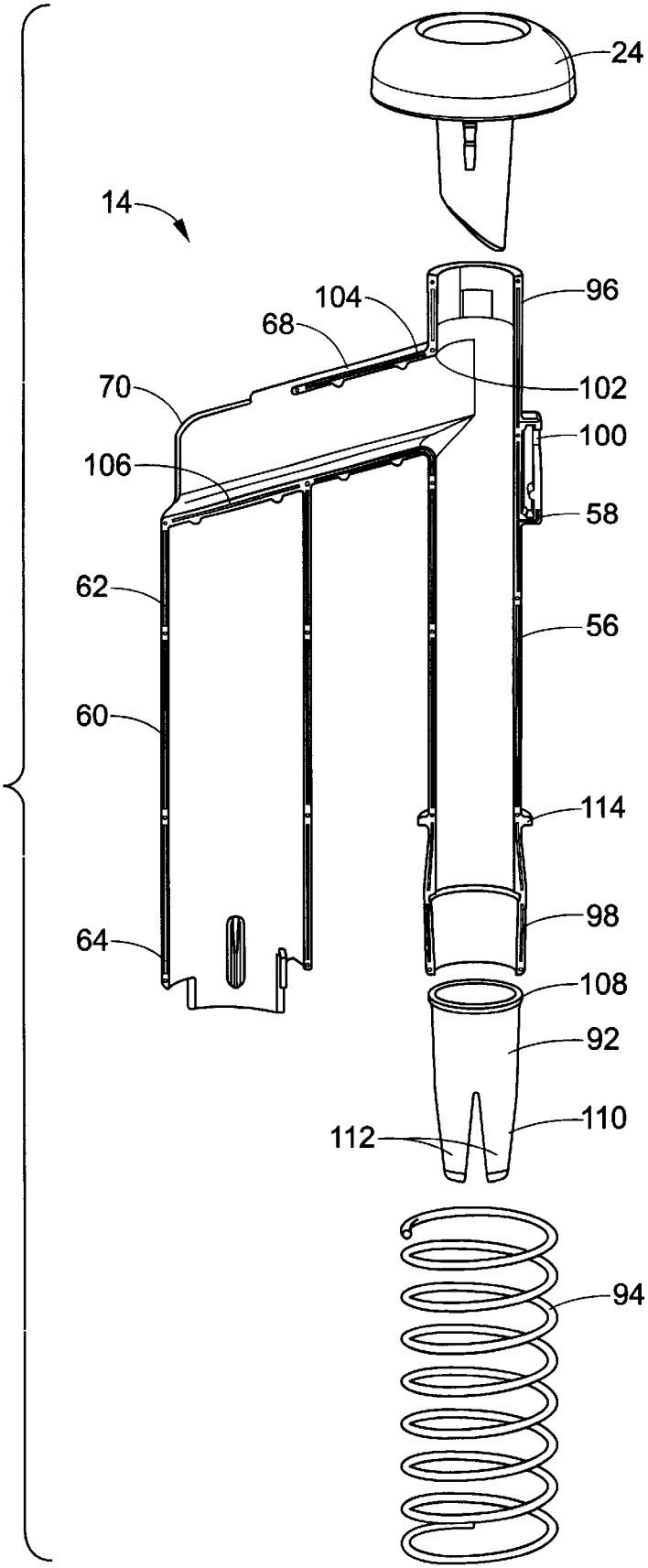
FIG. 9A is an exploded perspective view, partially in section, of several components of the dispenser and coin bank of FIG. 1.

With reference now also to FIG. 9A, the dispenser 14 includes a snack supply cylinder 56 upon which is mounted a housing 58. The projection 50 (FIG. 11) extending from the flange 48 of the depositing member 42 extends into this housing providing the contact point for the response of the depositing member 42 to actuation of the dispenser 14. The dispenser 14 also includes a snack feed cylinder 60 spaced apart and generally parallel to the supply cylinder 56. The feed cylinder has a first end 62 and a second end 64. With reference again to FIG. 11, a feed aperture 66 is defined in the feed cylinder 60 near the first end 62. The second end 64 defines an exit opening into the first storage area 16. A transfer channel 68 is also comprised in the dispenser 14, connecting the supply cylinder 56 to the feed cylinder 60 and extending therebetween. An exit 70 is defined in the transfer channel 68 proximate to the aperture 34 defined in the first end 32 of the ramp 18. The general operation of the dispenser 14 is to receive snacks in the feed cylinder 60 through the feed aperture 66, which are stored in the feed cylinder 60 and the first storage area 16 until they are picked up by the supply cylinder 56. The snacks are directed up the supply cylinder 56, as will be described below, and are then selectively dispensed down the transfer channel 68 into the ramp 18, where they travel in a visually pleasing helical pattern to the user.

Figure 14:
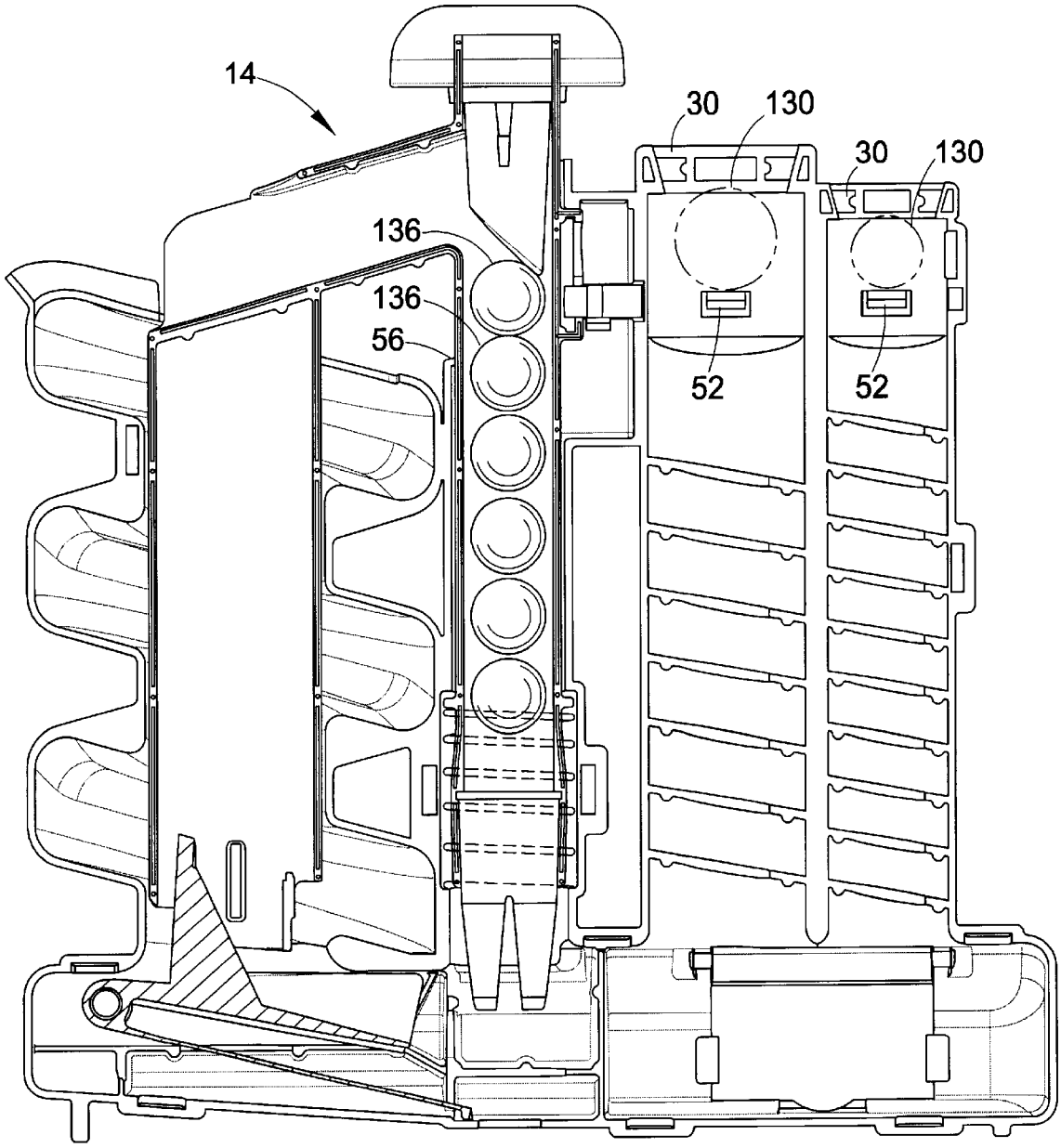
FIG. 14 is a sectional view of the dispenser and coin bank of FIG. 1 illustrating a dispenser in a first position.
Figure 15:
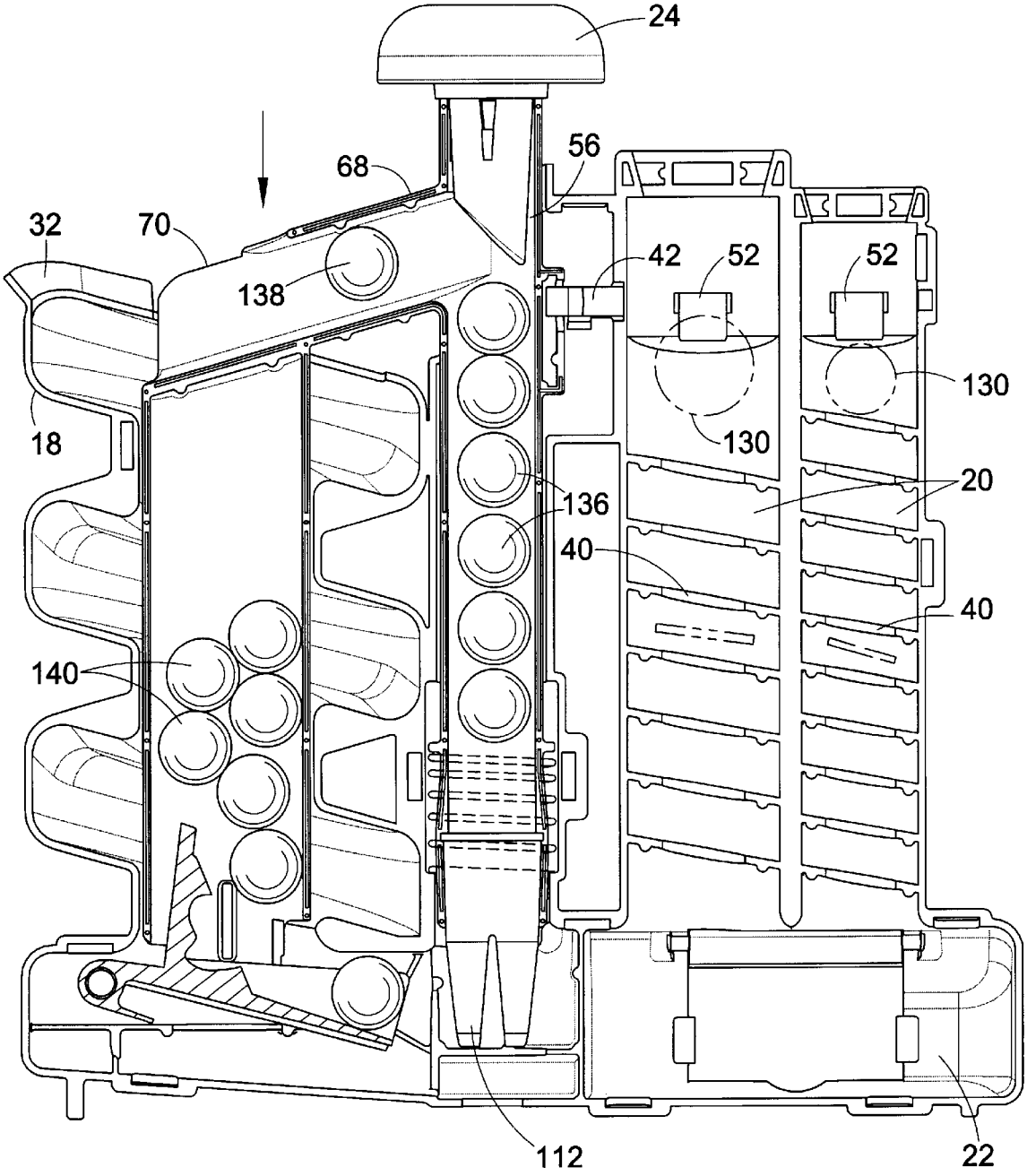
FIG. 15 is a sectional view of the dispenser and coin bank of FIG. 14 illustrating the dispenser in a second position.

A resiliently biased feed mechanism, which can be termed a spring 72, controls the deposit of snacks from the feed cylinder 60 to the first storage area 16. The spring comprises an inlet extension 74 which extends up into the second end 64 of the feed cylinder 60 to orient the fed snacks in a direction toward the supply cylinder 56. A deposited snack rides between a pair of opposed side walls 76 and on a base 78 of the spring 72. The second end 64 of the feed cylinder 60 acts upon at least one of the side walls 76 when the dispenser 14 is actuated, i.e., moved in a downward direction. This contact causes the side walls 76 and the base 78 of the spring 72 to move downward toward an arm 80 and thus compress. The arm 80 is secured to the housing 10 at a hook portion 82, thus allowing for stable compression about a pivot member 84 which is also secured to the housing 10. In this manner, the spring 72 defines a first position, as shown in FIG. 14, whereby a snack is received from the feed cylinder 60 and held. The spring 72 also defines a second position, as shown in FIG. 15, wherein the actuator 24 is depressed, causing the feed cylinder 60 to compress the spring 72, dispensing held snacks into a portion of the first storage area 16 beneath the supply cylinder 56.

With continued reference to FIG. 11, components of the ramp 18 will now be discussed. The helices of the ramp 18 are defined between sections of a cylindrical wall 86 which surrounds the feed cylinder 60 when the unit is assembled.

The cylindrical wall sections 86 serve to connect wall portions 88 of the ramp 18. Thus, a helical path 90 is defined by the wall portions 88 upon the connection of the housing halves 10A,10B.

Figure 10:
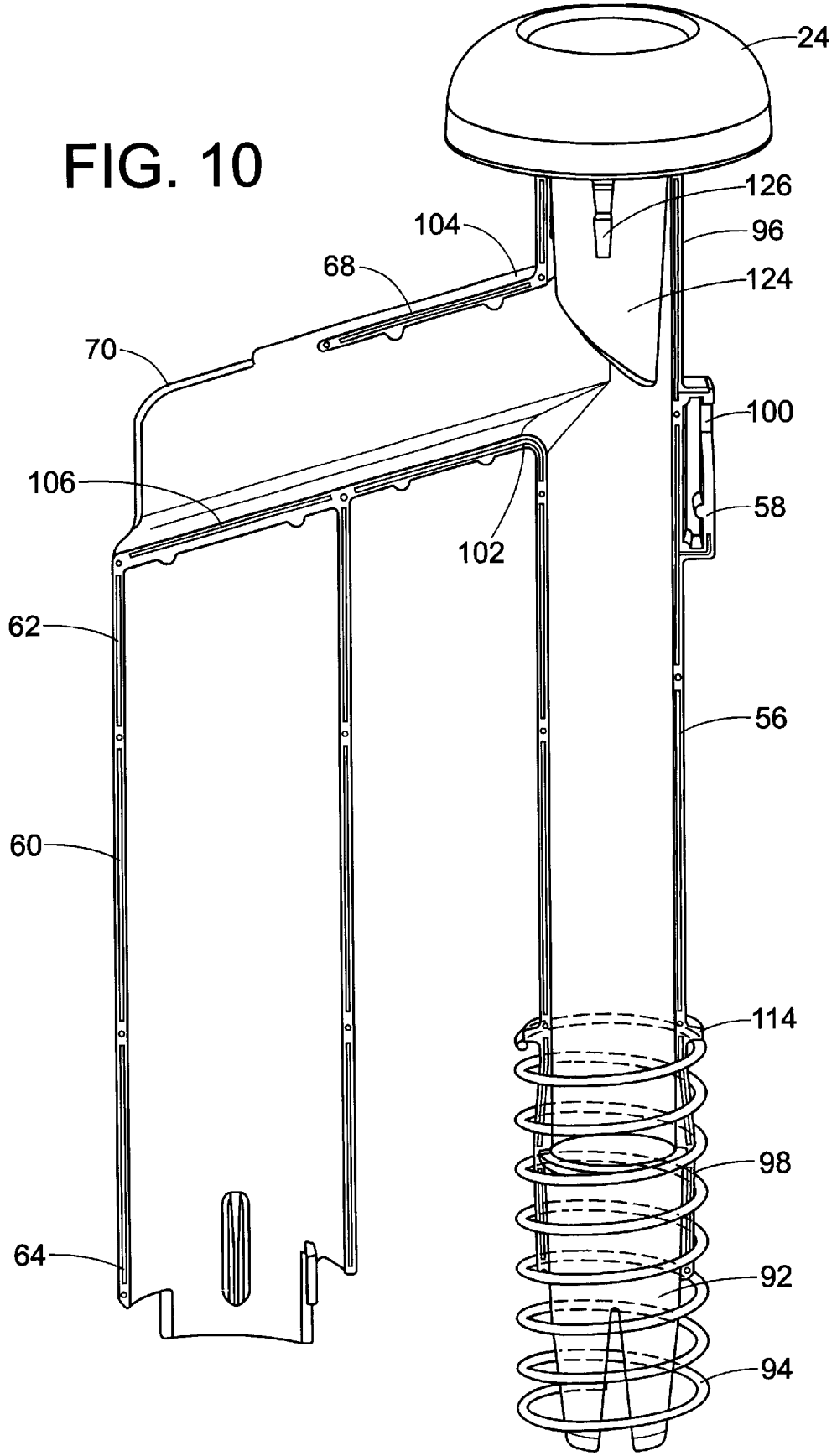
FIG. 10 is an enlarged assembled perspective view, partially in section, of the components of the dispenser and coin bank of FIG. 9A.

With reference now also to FIG. 10, two members which facilitate the essential functioning of the dispenser 14 are a tip member 92 and a spring 94 which are engaged with the supply cylinder 56 of the dispenser 14.

Turning now to FIG. 9A, the components of the dispenser 14 are depicted. The supply cylinder 56 is received by the shaft member 12 (not shown) and has a first end 96 and a second end 98. The actuator 24 is receivably engaged by the first end 96 of the supply cylinder 56. Near the first end 96 is the housing 58 which defines a longitudinally extending aperture 100 through which the projection 50 (not shown) of the flange 48 of the depositing member 42 extends. This construction allows the actuation of the depositing member 42 when the dispenser 14 is actuated. An aperture 102 larger than the outer diameter of a snack is defined in the wall of the supply cylinder 56 also near the first end 96. The transfer channel 68 connects the supply cylinder 56 to the feed cylinder 60 and has an inner surface cross section larger than the outer diameter of the associated snack to be dispensed. An entry end 104 of the transfer channel attaches to the supply cylinder 56 about the aperture 102 in the wall of the supply cylinder 56. The underside of the transfer channel 68 connects to feed cylinder 60 at point 106 to create the single dispenser unit 14. In the illustrated embodiment, the connection of the components is made such that the entry end 104 of the transfer channel 68 is positioned higher than the exit end 70, creating a downward slope of the transfer channel 68 away from the supply cylinder 56. This construction allows a snack to travel, via the force of gravity, from the first end 96 of the supply cylinder 56 through the transfer channel 68 to the first end of the ramp 32 (referring to FIG. 11).

Figure 13:
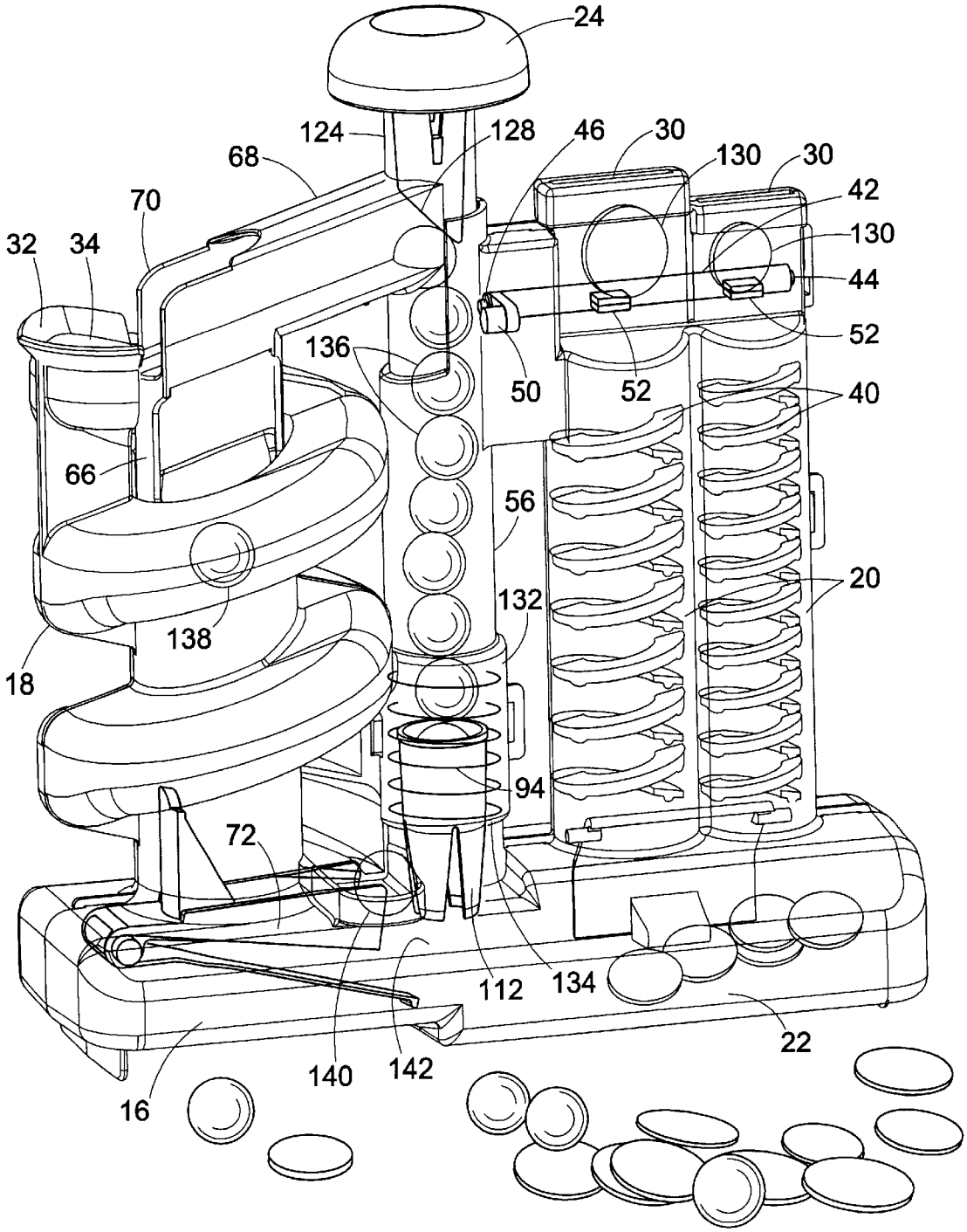
FIG. 13 is a perspective view of the dispenser and coin bank of FIG. 1 in use with snacks and coins in accordance with one embodiment of the present invention.

With continuing reference to FIG. 9A, the inner surface of the second end 98 of the supply cylinder 56 receivably engages the tip member 92. The tip member 92 comprises a first end 108 and a second end 110. Near the first end 108, the tip member 92 defines an inner diameter that is slightly larger than the outer diameter of an associated snack. The first end 108 of the tip member 92 engages the supply cylinder 56. At the second end 110 of the tip member 92, at least two fingers 112 are defined. The inner diameter of the fingers 112 is smaller than the inner diameter of the rest of the tip member 92 to allow the fingers 112 to engage the snack to be dispensed. The fingers 112, and perhaps the remainder of the tip 92, are formed from resilient material such as a polymer in order to engage the snack. The preferable shape of a snack to be engaged by the fingers 112 is spherical, however, the shape and configuration of the fingers 112 may be adjusted to accommodate other shapes of snacks. The inner diameter of the supply cylinder 56 is slightly larger than the outer diameter of a corresponding snack so that snacks may pass through yet be stacked in a single manner, i.e., one on top of another. Thus, the fingers 112 engage a snack and hold it. When another snack is engaged, the prior snack is pushed up by the new snack into the first end 108 of the tip member 92. The stacking continues so that snacks extend throughout the length of the inner diameter of the supply cylinder 56, as best shown in FIG. 13.

When the supply cylinder 56 is filled with snacks, the aperture 102 is positioned so that the addition of one snack at the second end 98 of the supply cylinder 56 from the first storage area 14 causes the stack of snacks to rise to a level where an uppermost snack will proceed through the aperture 102 and into the transfer channel 68 for delivery to the ramp 18. This addition of a snack which causes the dispensing of another snack is created by actuation of the dispenser 16 caused by a user pressing down on the actuator 24. The act of pressing the actuator 24 in a downward direction thus causes the depositing member 42 to release deposited coins into the chutes 20, as described above, and to simultaneously release a selected snack to the ramp 18, creating the illusion of the coins and the selected snack racing one another along different spiraling paths.

After actuation, the dispenser is urged upwardly and returns to an at rest mode through the action of the springs 72 and 94. As shown in FIG. 10, the outer surface of the second end 98 of the supply cylinder 56 receivably engages the spring 94 while retainer projections 114, located on the outer diameter of the supply cylinder 56 near the second end 98, provide a positive stop, thus fixing the location of the spring 94 on the supply cylinder 56. As a result, when the dispenser 14 is actuated, the spring 94 is compressed, then returning the dispenser to an at rest position upon release of the actuator 24 by a user. As will be described below in FIG. 13, the shaft member 12 includes a spring housing 132 which cooperates with the supply cylinder 56 to fix the location and the movement of the spring 94.

Figure 9B:
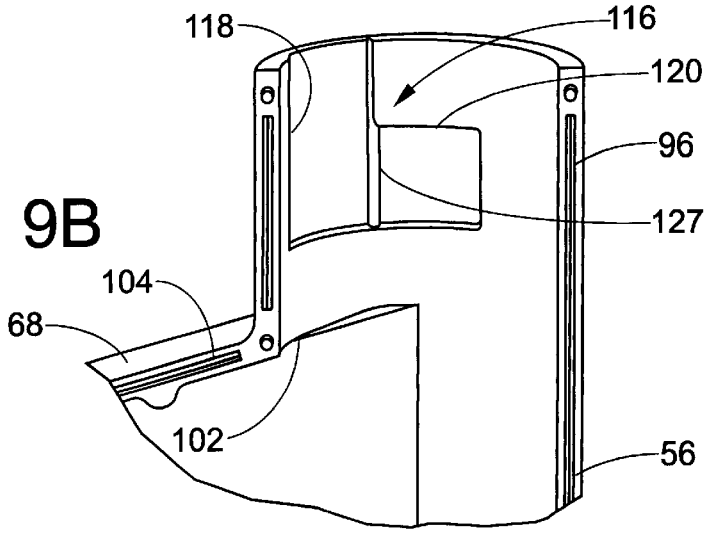
FIG. 9B is an enlarged sectional view of a portion of a component of the dispenser and coin bank of FIG. 9A.
Figure 9C:
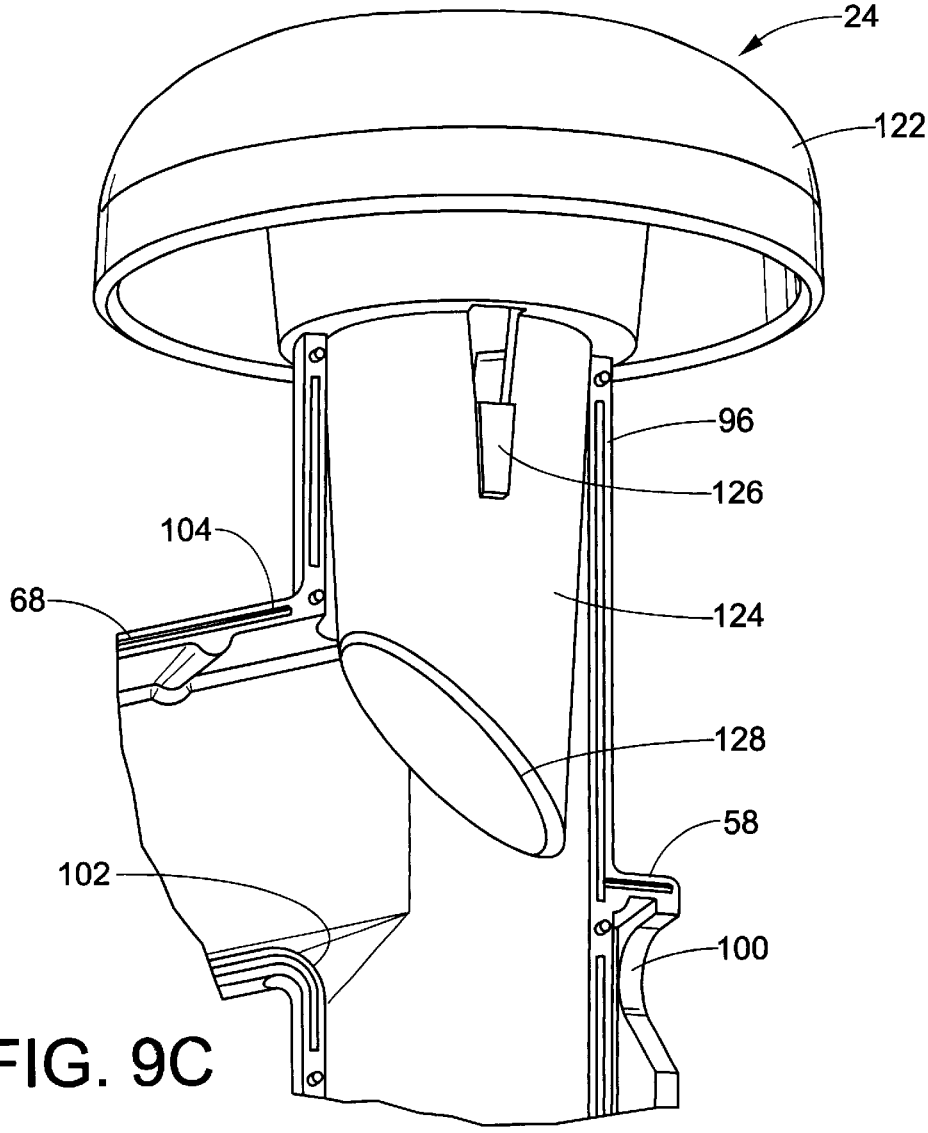
FIG. 9C is an enlarged assembled perspective view, partially in section, of several components of the dispenser and coin bank of FIG. 9A.

FIGS. 9B and 9C illustrate a manner in which the actuator 24 may be secured to the supply cylinder 56 of the dispenser 14. At the first end 96 of the supply cylinder 56 a slot 116 is defined consisting of a vertical portion 118 and a horizontal portion 120. The actuator 24 comprises a knob portion 122 and a stem portion 124. A locking projection 126 extends from a portion of the outer periphery of the stem 124. When the stem 124 is inserted into the first end 96 of the supply cylinder 56, the locking projection 126 is aligned with the vertical portion 118 of the slot 116 as it is inserted into the slot 116. When the locking projection 126 can proceed no further into the vertical portion 118, the knob 122 is rotated by the user so as to move the locking projection 126 into the horizontal portion 120 of the slot 116. After the locking projection 126 moves past a rib 127, which separates the vertical portion 118 from the horizontal portion 120, the rib 127 prevents easy movement of the locking projection back to the vertical portion 118, thereby securing the actuator 24 onto the supply cylinder 56. The stem 124 has an angled distal surface 128 which orients and allows a selected snack to pass from the supply cylinder 56, through the aperture 102 to the transfer channel 68.

The assembled state of the tip member 92 and the spring 94 to the second end 98 of the supply cylinder 56 is shown in FIG. 10. The retainer 114 secures the spring 94, allowing the dispenser 14 to return to the at rest position after actuation.

Turning now to FIG. 13, a perspective view of an embodiment of the present invention made from transparent or translucent material is shown. Because it is desirable for the snack and the coins to be viewed as,they travel through the ramp 18 and the chutes 20, the components of the housing 10 may be molded from a transparent or translucent polymeric material. Coins 130 are positioned in the slots 30 on the paddles 52, ready to be released into the coin chutes 20 when the depositing member 42 is actuated by movement of the supply cylinder 56 responding to downward pressure on the actuator 24. The shaft member 12 includes a spring housing portion 132 which receivably engages the spring 94 in its inner diameter and fixes the spring 94 in place. Specifically, a lower wall 134 of the spring housing portion 132 contacts a bottom portion of the spring 94 to prevent movement of the spring 94 beyond the lower wall 134. Thus, the limits of the movement of the spring are fixed at an upper end by the retainer 114 (referring back to FIG. 10) on the supply cylinder 56 and at a lower end by the lower wall 134 of the spring housing 132. The retainer 114 on the supply cylinder 56 is also housed within the spring housing 132, causing the upper end of the spring 94, and hence, the complete spring 94, to be held within the spring housing 132.

Snacks 136 are shown stacked in the supply cylinder 56 of the dispenser 14 which is received by the shaft member 12. Thus, when the actuator 20 is depressed, the dispenser 14 moves downward, allowing the tip fingers 112 to pick up a snack, thereby increasing the height of the stack of snacks within the supply cylinder 56. If the stack of snacks is full, an uppermost snack 138 is caused to proceed into the transfer channel 68. The selected snack 138 rolls down the transfer channel 68 and out of the exit end 70 and into the aperture 34 defined by the first end 32 of the ramp 18. The snack then rolls through the helically-shaped ramp 18. Depression of the actuator 24 also activates the rotation of the depositing member 42, which causes the paddles 52 to rotate away from the coins 130, thus releasing the coins 130 into the chutes 20 and onto the helical projections 40, where they slide down to the second storage area 22.

With continuing reference to FIG. 13, the orientation of the spring 72 within the first storage area 16 is also shown. When a fed snack 140 is dropped through the feed aperture 120, the fed snack drops onto the spring 72 which is in the first, i.e., holding position. When the actuator 20 is depressed, the spring 72, as best shown in FIG. 15, moves to the second position and deposits the fed snack to a portion 142 of the first storage area 16 beneath the supply cylinder 56 where the fingers 122 may engage the snack 140 upon the next actuation.

Figure 8:
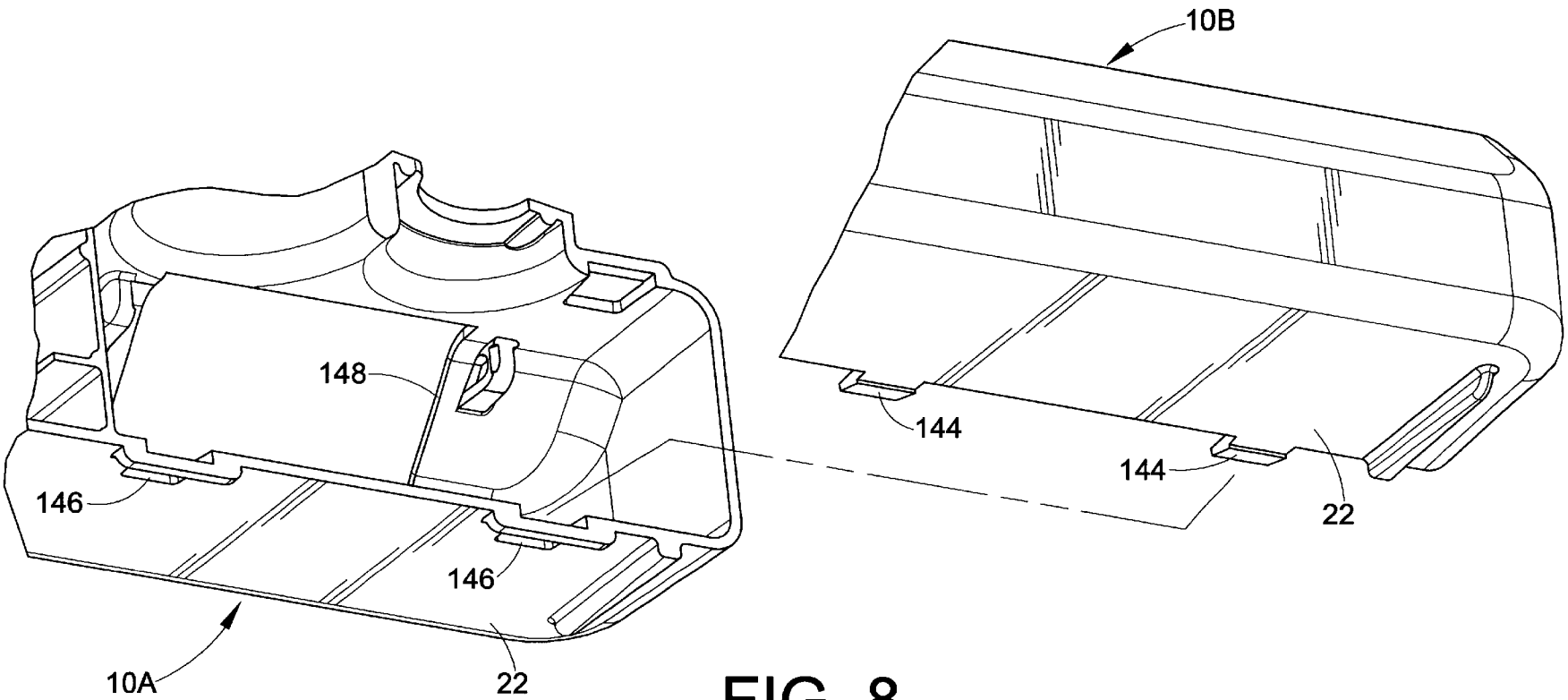
FIG. 8 is an enlarged exploded perspective view of a lower portion of a housing of the dispenser and coin bank of FIG. 1.

With reference to FIG. 8, a mating component structure designed for snap-fit assembly is evident in an exploded perspective view of a lower portion of the housing 10. Mating components 10A,10B may be molded and then snapped or welded together, which provides sturdy construction yet simple assembly. For example, tabs 144 in half 10B are designed to be inserted into slots 146 defined in half 10A and then lock in place to secure the halves 10A,10B together. Also shown is an aperture 148 defined in the second storage area 22 to allow a user to access the coins after they have been deposited. By reaching into the aperture 148, a user may retrieve deposited coins.

Figure 12:
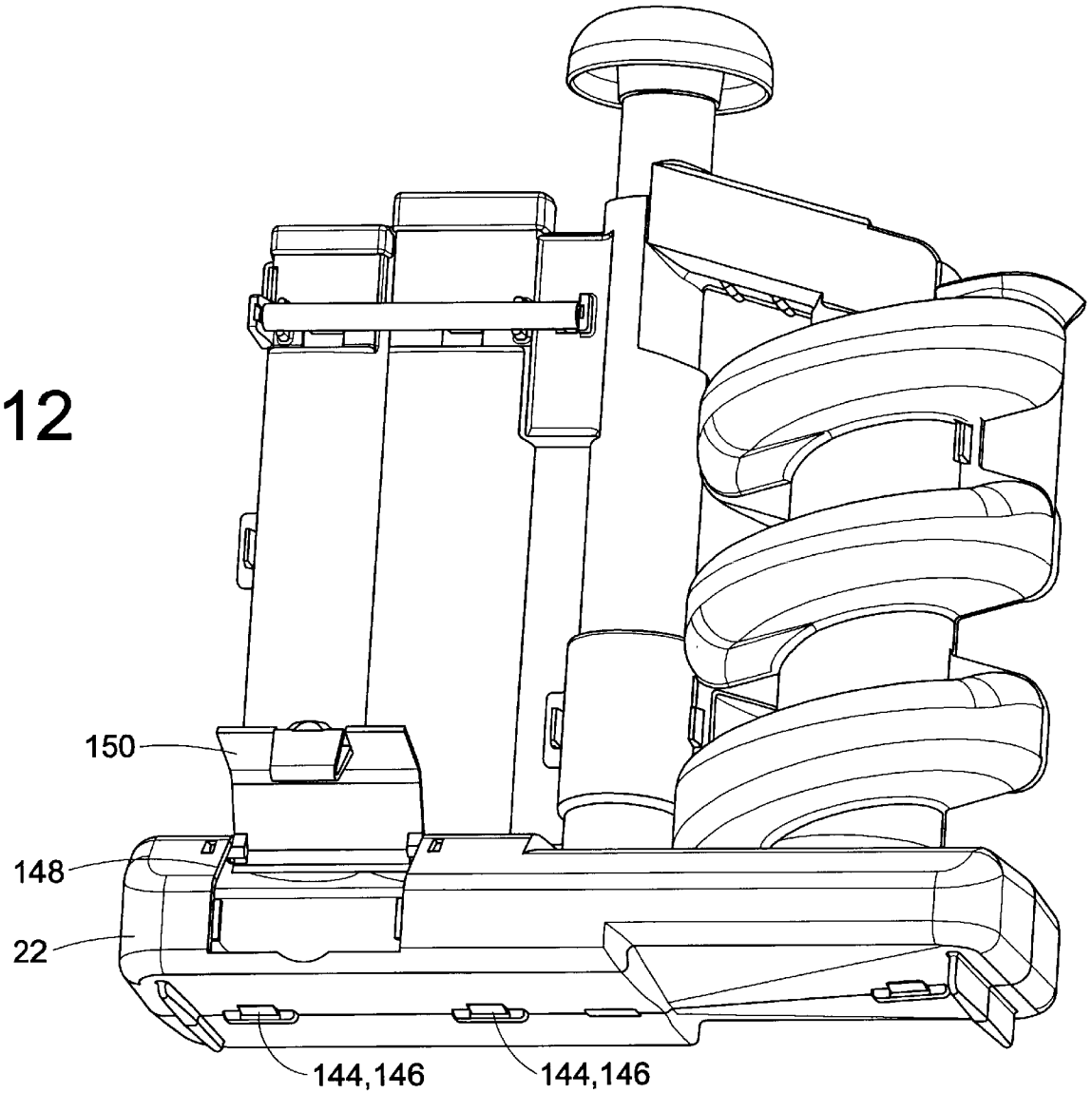
FIG. 12 is a rear perspective view of the dispenser and coin bank of FIG. 1.

FIG. 12 depicts a rear perspective view of the housing 10. From this angle, the assembled tabs 144 and the slots 146 are shown. In addition, a cover 150 may be rotatably mounted over the aperture 148 defined in the second storage area 22 so as to allow access by a user to the second storage area 22 only when the cover 150 is open.

Turning now to FIG. 5, the attachment of housing halves 10A,10B along the mating line 152 by tabs 144 and slots 146 is shown.

Figure 6:
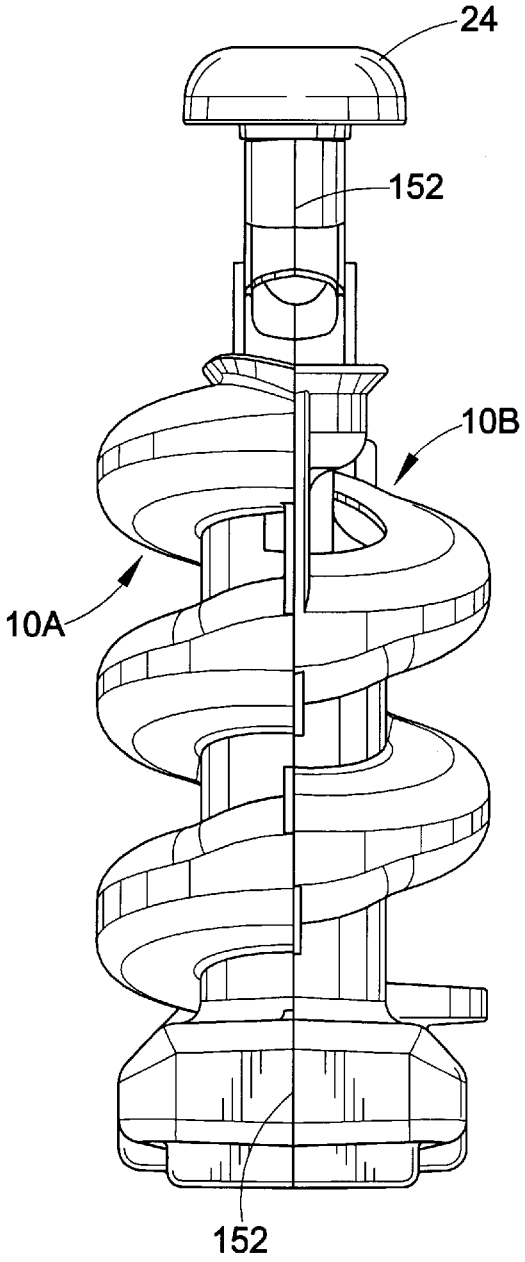
FIG. 6 is a left side elevational view of the dispenser and coin bank of FIG. 1.
Figure 7:
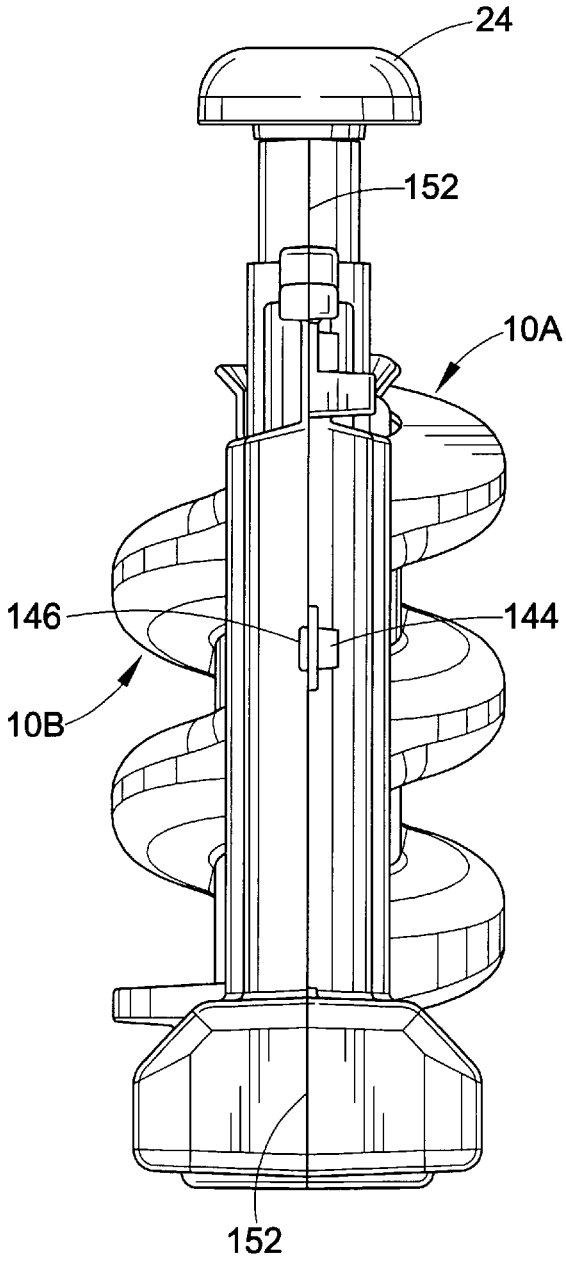
FIG. 7 is a right side elevational view of the dispenser and coin bank of FIG. 1.

FIGS. 6 and 7 illustrate mating line 152 of the halves 10A,10B of the housing. The actuator 24 spans the mating line 152 due to its insertion into the supply cylinder. Tab 144 and slot 146 are again shown to illustrate a snap fit construction, which provides sturdy construction yet simple assembly. The mating components may also be welded or fit together by other techniques known in the art.

Figure 2:
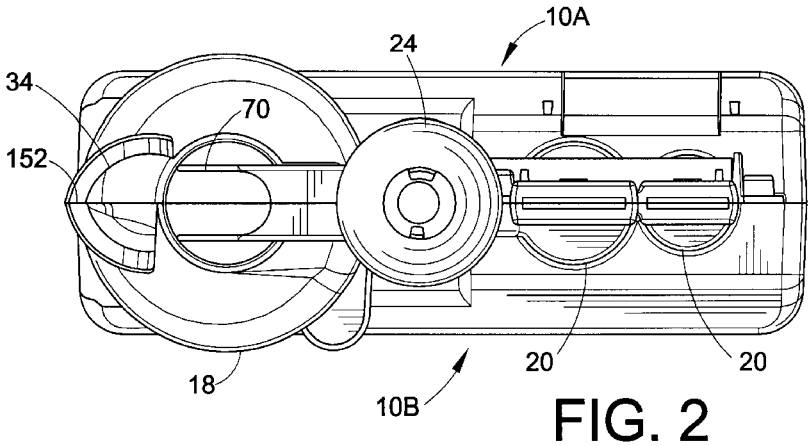
FIG. 2 is a top plan view of the dispenser and coin bank of FIG. 1.

Turning now to FIG. 2, the relationship of the ramp 18 and the chutes 20 with the actuator 24 is evident. Also, the alignment of the transfer channel exit 70 with the ramp inlet aperture 34 is shown. Essentially, a snack drops directly from the transfer channel exit 70 into the ramp aperture 34 to travel down the ramp 18.

Figure 3:
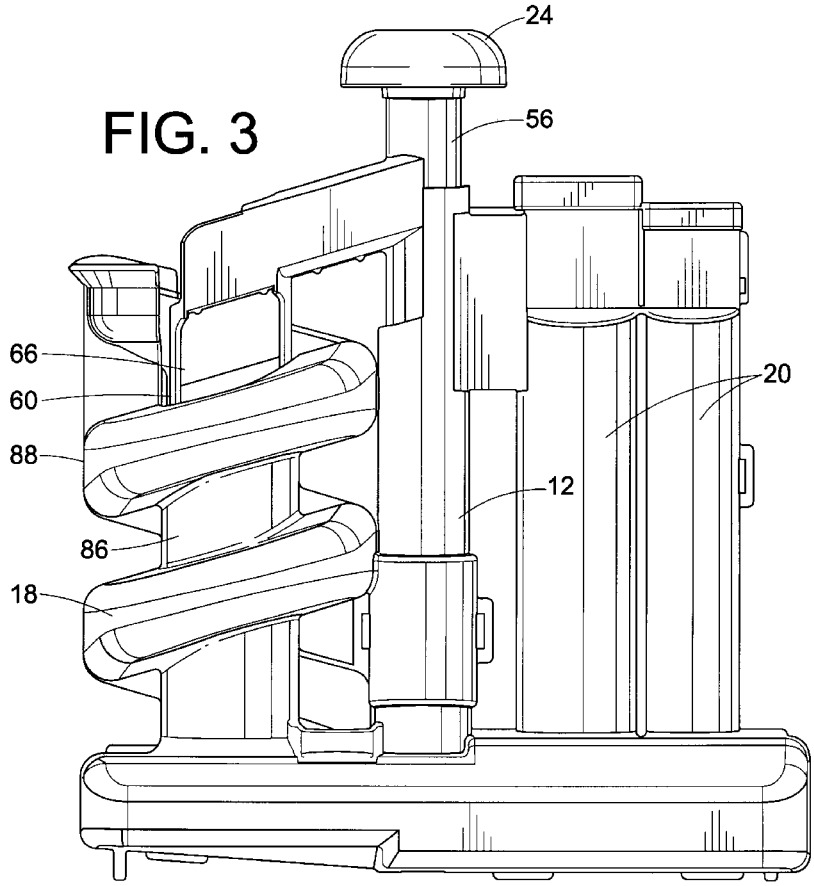
FIG. 3 is a front elevational view of the dispenser and coin bank of FIG. 1.

With reference to FIG. 3, the feed aperture 66 defined in the feed cylinder 60 is proximate to the ramp helical walls 88. The ramp cylindrical walls 86 surround the feed cylinder 60 and do not extend over the feed aperture 66. Further, the actuator 24 is located on the supply cylinder 56 which is received by the shaft 12.

In FIG. 4, the mounting of the depositing member 42 in the housing 10 is shown as extending across the chutes 20 from the first end 44 of the member 42 to the second end 46 adjacent the shaft 12. The paddles 52 extend into the channels 20. The cover 150 over the aperture 148 in the second storage area 22 is depicted in a closed position.

A method of saving coins and receiving a snack is also disclosed by the present invention. FIG. 14 illustrates some of the initial steps of the method. First, at least one coin 130 is placed in one of the slots 30. Two coins 130 are shown, one in each slot 30. The paddles 52 hold the coins 130 in place. Snacks 136, which are gumballs in the current embodiment, are stacked up in the supply cylinder 56 of the dispenser 14.

Turning now to FIG. 15, the actuator 24 is depressed, causing the coins 130 to be released into the coin chutes 20 and onto the helical projections 40 where they travel in a spiraling manner in a generally downward direction until they are deposited into the second storage area 22. As the coins 130 are released, a selected gumball 138 passes into the transfer channel 68 as a result of the downward motion of the actuator 24. The selected gumball 138 rolls down the transfer channel exit 70 and into the first end 32 of the ramp 18. It then travels down the ramp 18 in a spiraling direction until the user can retrieve the gumball 138 at the tray 38 (FIG. 1).

The present invention provides a simple structure which facilitates a visually pleasing delivery of a reward as well as a visually pleasing manner of depositing a coin. Because the coins and the snacks all travel in a generally downward spiraling manner, their travel patterns are similar, adding to the visual effect of the present invention. A child or other user can enjoy watching a coin or coins race a gumball, to see which reaches its destination first. No motors are involved, illustrating the unique, simple operation of the present invention according to levers, springs and gravity. Further, the simple design of the present invention allows easier manufacture and assembly than the prior art.

The invention has been described with reference to a preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the invention, we claim:

1. A snack dispenser and coin bank, comprising:

a housing;

a shaft member comprising a portion of said housing;

a first storage area located in said housing for storing associated snacks;

a dispenser movably mounted in said shaft for selectively dispensing the associated snack;

a depositing member movably mounted in said housing for selectively allowing the deposit of associated coins in said housing, said depositing member being operatively connected to said dispenser; and an actuator mounted on said dispenser, wherein when said actuator is moved to one position, it actuates said dispenser and said depositing member.

2. The snack dispenser and coin bank of claim 1, wherein the housing comprises at least one coin chute.

3. The snack dispenser and coin bank of claim 2, further comprising a second storage area located in said housing for receiving deposited coins from the chute and storing the coins.

4. The snack dispenser and coin bank of claim 3, wherein the second storage area defines an opening to allow a user to access deposited coins.

5. A snack dispenser and coin bank, comprising:

a housing;

a first storage area located in said housing for storing associated snacks;

a dispenser movably mounted in said housing for selectively dispensing the associated snack, said dispenser comprising a supply cylinder, a feed cylinder and a channel extending therebetween;

a depositing member movably mounted in said housing for selectively allowing the deposit of associated coins in said housing, said depositing member being operatively connected to said dispenser; and an actuator mounted on said dispenser, wherein when said actuator is moved to one position, it actuates said dispenser and said depositing member.

6. The snack dispenser and coin bank of claim 5, wherein the supply cylinder of the dispenser includes a first end and a second end and defines an inner diameter larger than an outer diameter of the associated snack which is to be dispensed.

7. The snack dispenser and coin bank of claim 6, wherein the first end of the supply cylinder of the dispenser receivably engages said actuator.

8. The snack dispenser and coin bank of claim 5, wherein the feed cylinder of the dispenser includes a first end and a second end and defines an inner diameter larger than that of the associated snack to be dispensed;

the first end of the feed cylinder of the dispenser attaching to a lower surface of the channel;

the second end of the feed cylinder of the dispenser extending to a location generally proximate to the first storage area; and the feed cylinder of the dispenser defining an aperture near the first end of the feed cylinder, whereby the associated snack to be dispensed is received into the inner diameter of the feed cylinder.

9. A snack dispenser and coin bank, comprising:

a housing;

a first storage area located in said housing for storing associated snacks;

a dispenser movably mounted in said housing for selectively dispensing the associated snack;

a ramp located in said housing for delivering the associated snack to a user;

the ramp including a first end and a second end and defining an inner diameter larger than an outer diameter of the associated snack to be dispensed;

a tray communicating with said ramp second end to receive the associated snack to be dispensed;

a depositing member movably mounted in said housing for selectively allowing the deposit of associated coins in said housing, said depositing member being operatively connected to said dispenser; and an actuator mounted on said dispenser, wherein when said actuator is moved to one position, it actuates said dispenser and said depositing member.

10. The snack dispenser and coin bank of claim 9, wherein the general shape of the ramp is a helix.

11. A snack dispenser and coin bank, comprising:

a housing;

a dispenser movably mounted in said housing, the dispenser comprising a supply cylinder, a feed cylinder and a channel extending therebetween;

the supply cylinder of the dispenser including a first end and a second end and defining an inner diameter larger than an outer diameter of the associated snack to be dispensed;

an outer surface of the second end of the supply cylinder of the dispenser receivably engaging a spring, wherein the spring is mounted in a spring housing defined by a portion of said housing;

a depositing member mounted in said housing for selectively allowing the deposit of associated coins in said housing, said depositing member being operatively connected to said dispenser; and an actuator mounted on the dispenser for selectively actuating said dispenser and said depositing member.

12. The snack dispenser and coin bank of claim 11, wherein the second end of the supply cylinder of the dispenser receivably engages a tip member.

13. The snack dispenser and coin bank of claim 12, wherein the tip member comprises a first end and second end;

the first end of the tip member engaging the second end of the supply cylinder of the dispenser and defining an inner diameter larger than that of the associated snack to be dispensed; and the second end of the tip member including at least two fingers which define an inner diameter that is no greater than a diameter of the associated snack to be dispensed, wherein the fingers engage the associated snack to be dispensed.

14. A snack dispenser and coin bank, comprising:

a housing;

a dispenser movably mounted in said housing, the dispenser comprising a supply cylinder, a feed cylinder and a channel extending therebetween;

a depositing member mounted in said housing for selectively allowing the deposit of associated coins in said housing, said depositing member being operatively connected to said dispenser; and an actuator mounted on the dispenser, the actuator comprising a knob and a stem depending from said knob, said stem comprising an angled distal surface for engaging an associated snack and orienting the associated snack in one direction when the actuator and the dispenser are moved in relation to the housing.

15. The snack dispenser and coin bank of claim 14, wherein the supply cylinder of the dispenser includes a first end and a second end and defines an inner diameter larger than a diameter of the associated snack to be dispensed; and a portion of a wall of the supply cylinder of the dispenser near the first end defining an aperture larger than a diameter of the snack to be dispensed.

16. The snack dispenser and coin bank of claim 14, wherein the transfer channel of the dispenser includes an entry end and an exit end;

the entry end of the channel connecting to the supply cylinder portion of the dispenser about the aperture defined near the first end of the wall of the supply cylinder;

the channel defining an inner surface larger in cross section than the diameter of the associated snack to be dispensed; and the exit end of the channel positioned proximate to an inlet of a ramp.

17. The snack dispenser and coin bank of claim 14, wherein the first end of the channel is positioned at a point higher than a point at which the second end of the channel is positioned so as to create an orientation of the channel that is generally sloping in a downward manner away from the supply cylinder of the dispenser.

18. A snack dispenser and coin bank, comprising:

a housing;

a first storage area located in said housing for storing associated snacks;

a spring located in said first storage area, the spring defining a first position and a second position and receiving an associated snack to be dispensed when in the first position;

the spring depositing the associated snack to be dispensed to a portion of the first storage area when said spring is in the second position;

a dispenser mounted in said housing for selectively acting on the spring and dispensing the associated snack;

a depositing member mounted in said housing for selectively allowing the deposit of associated coins in said housing, said depositing member being operatively connected to said dispensing member; and an actuator mounted on the dispenser, for selectively actuating said dispenser and said depositing member.

19. A snack dispenser and coin bank, comprising:

a housing;

a first storage area located in said housing for storing associated snacks;

a dispenser mounted in said housing for selectively dispensing the associated snack;

a second storage area located in said housing for storing associated coins;

a depositing member mounted in said housing for selectively allowing the deposit of the associated coins into said second storage area, said depositing member being operatively connected to said dispenser;

at least one coin chute extending between said depositing member and said second storage area, said at least one coin chute defining a first end, a second end that defines an exit point from the coin passage into the second storage area, and an inner diameter greater than that of a coin denomination for which the coin chute is designed;

a slot defined by said first end of said at least one coin chute, wherein said slot is of a width and length slightly larger than a largest cross section of a coin of a denomination for which the passage is designed;

a lever arm included in said first end of said at least one first coin chute, the lever arm having a projection extending into a portion of the defined slot, and wherein the lever arm cooperates with said dispenser; and an actuator mounted on the dispenser, for selectively actuating said dispenser and said depositing member.

20. The snack dispenser and coin bank of claim 19, further comprising a second coin chute wherein said second coin chute is of a larger inner diameter than said first coin chute.

21. A method of saving coins and receiving a snack, comprising:

placing at least one coin in an aperture defined at one end of a coin chute in a housing holding snacks;

pressing an actuator knob mounted on the housing;

releasing the coin and a snack into, respectively, a coin chute and a snack dispensing ramp;

causing the coin and the snack to each travel in generally downward direction;

depositing the coin in a coin storage area in the housing; and receiving the snack.

22. A snack dispenser and coin bank, comprising;

a housing;

a dispenser mounted in said housing for selectively dispensing an associated snack;

a depositing member mounted in said housing for selectively allowing the deposit of an associated coin into said housing;

at least one coin chute extending between said depositing member and said housing, said at least one coin chute defining a first end and a second end and an inner diameter greater than that of a coin denomination for which the coin chute is designed; and at least one coin deflector positioned in said coin chute for deflecting the travel of a coin in said coin chute from an inlet end to an exit end thereof, wherein said depositing member is located adjacent said inlet end of said coin chute and said at least one coin deflector is located downstream from said depositing member.

* * * * *